US006228010B1

(12) United States Patent
Toriyama

(10) Patent No.: US 6,228,010 B1
(45) **Date of Patent: *May 8, 2001**

(54) BOX SHEET BENDING APPARATUS

(75) Inventor: Daigoro Toriyama, Nagareyama (JP)

(73) Assignee: Tanabe Machinery Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/203,703

(22) Filed: Dec. 2, 1998

(30) Foreign Application Priority Data

May 13, 1998 (JP) ..... 10-146662

(51) Int. Cl.[7] ..... B31B 1/26; B31B 1/52

(52) U.S. Cl. ..... 493/23; 493/177; 493/183; 493/436

(58) Field of Search ..... 493/23, 177, 183, 493/436

(56) References Cited

U.S. PATENT DOCUMENTS

| | | | | |
|---|---|---|---|---|
| 2,899,872 | * | 8/1959 | Labombarde | 493/177 |
| 3,285,144 | * | 11/1966 | Frei | 493/436 |
| 3,388,641 | * | 6/1968 | Gobel | 493/177 |
| 4,432,745 | * | 2/1984 | Eldridge | 493/177 |
| 4,539,002 | * | 9/1985 | Zak | 493/23 |
| 4,629,445 | | 12/1986 | Toriyama . | |
| 5,232,428 | * | 8/1993 | Jambor | 493/177 |
| 5,876,329 | * | 3/1999 | LeCompte | 493/125 |

FOREIGN PATENT DOCUMENTS

| | | |
|---|---|---|
| 1125753 | 3/1962 | (DE) . |
| 1169271 | 4/1964 | (DE) . |
| 1071758 | 6/1967 | (GB) . |
| 2165042 | 4/1986 | (GB) . |
| 3922278 | 10/1939 | (JP) . |
| 52-144918 | 11/1977 | (JP) . |
| 53-120993 | 10/1978 | (JP) . |
| 60-94936 | 6/1985 | (JP) . |

* cited by examiner

*Primary Examiner*—Peter Vo
*Assistant Examiner*—Hemant M. Desai
(74) *Attorney, Agent, or Firm*—Fulbright & Jaworski, LLP

(57) ABSTRACT

An apparatus for bending a box sheet along a fold formed at a predetermined position in the box sheet comprising a hook which can hang a tip of the sending box sheet, a sensor which can detect said tip of the sending box sheet, and a lifting means which can lift a part between said tip and a first fold of the sending box sheet up, wherein a tip of said hook is positioned above a sending route of the box sheet, and wherein, when said sensor detects said tip of the sending box sheet, said lift means can lift said part between the tip and the first fold of the sending box sheet up to said position of said hook.

4 Claims, 5 Drawing Sheets

BOX SHEET BENDING APPARATUS

BACKGROUND OF THE INVENTION

1. Field of the Invention

The present invention relates to the field of box-making machines, Specifically, the present invention provides an apparatus for bending a sending box sheet or a sending box sheet blank along a fold formed at a predetermined position in the box sheet.

2. Description of the Related Art

Conventionally, an apparatus for bending a sending box sheet along a fold formed at a predetermined position in the box sheet comprises a hook, which can hang a tip of the sending box sheet, and a sensor which can detect said tip of the sending box sheet. Accordingly, said sensor can detect said tip of the sending box sheet, and said hook can bend the sending box sheet along a first fold by holding a tip of the sending box sheet.

Namely, as shown in FIG. 8(*a*), in a typical device for bending a sending box sheet along a fold, a hook 5 is provided. The hook 5 is pressed by a spring for an opposite direction (left direction of FIG. 8(*a*)) of a sending direction of a box sheet 1 and can move the sending direction (right direction of FIG. 8 (*a*)) of the box sheet 1. A tip 5*a* of the hook 5 is positioned on a sending route of the box sheet. Therefore, when the box sheet 1 is sent, the tip 5*a* of the hook 5 holds the tip 1*a* of the sending box sheet 1.

When the box sheet is further sent, the hook 5 moves in the sending direction of the sending box sheet 1. Then, as shown in FIG. 8(*b*), the box sheet I is bent along a first fold by a force of the spring. The box sheet is further sent, as shown in FIG. 8(*c*), and because the tip 5*a* of the hook 5 is left of the tip 1*a* of the box sheet 1, the hook 5 is restored by force of the restitution of the spring, and then the bending box sheet 1 is sent frontwards.

The typical device for bending a sending box sheet along a fold being thus described, it is possible to bend the box sheet automatically during the process of sending the box sheet. However, because the tip of the hook is on a sending route of the box sheet, when the hook is restored, the tip of the hook hits on a face of the sending box sheet, thereby making a noise. In cases where the box sheet is sent at high speed, the noise increases. Furthermore, certain countries regulate the importation of a device which makes noise beyond a prescribed level.

SUMMARY OF THE INVENTION

An objection of the present invention is to overcome the above-described problems and to provide an apparatus for bending a box sheet along a fold formed at a predetermined position in the box sheet comprising: a hook which can hang a tip of the sending box sheet; a sensor which can detect said tip of the sending box sheet; and a lifting means which can lift a part between said tip and a first fold of the sending box sheet; wherein a tip of said hook is positioned above a sending route of the box sheet; and wherein said sensor detects said tip of the sending box sheet, and said lift means can lift said part between the tip and the most fore fold of the sending box sheet up to said position of said hook.

According to the present invention, given that the tip of the hook is positioned above a sending route of the box sheet, when the hook is restored, the tip of the hook does not hit on the face of the sending box sheet, and therefore a noise is not made.

DETAILED DESCRIPTION OF THE INVENTION

Preferred embodiments of the present invention are described below in detail with reference to the accompanying drawings.

Figure 1:
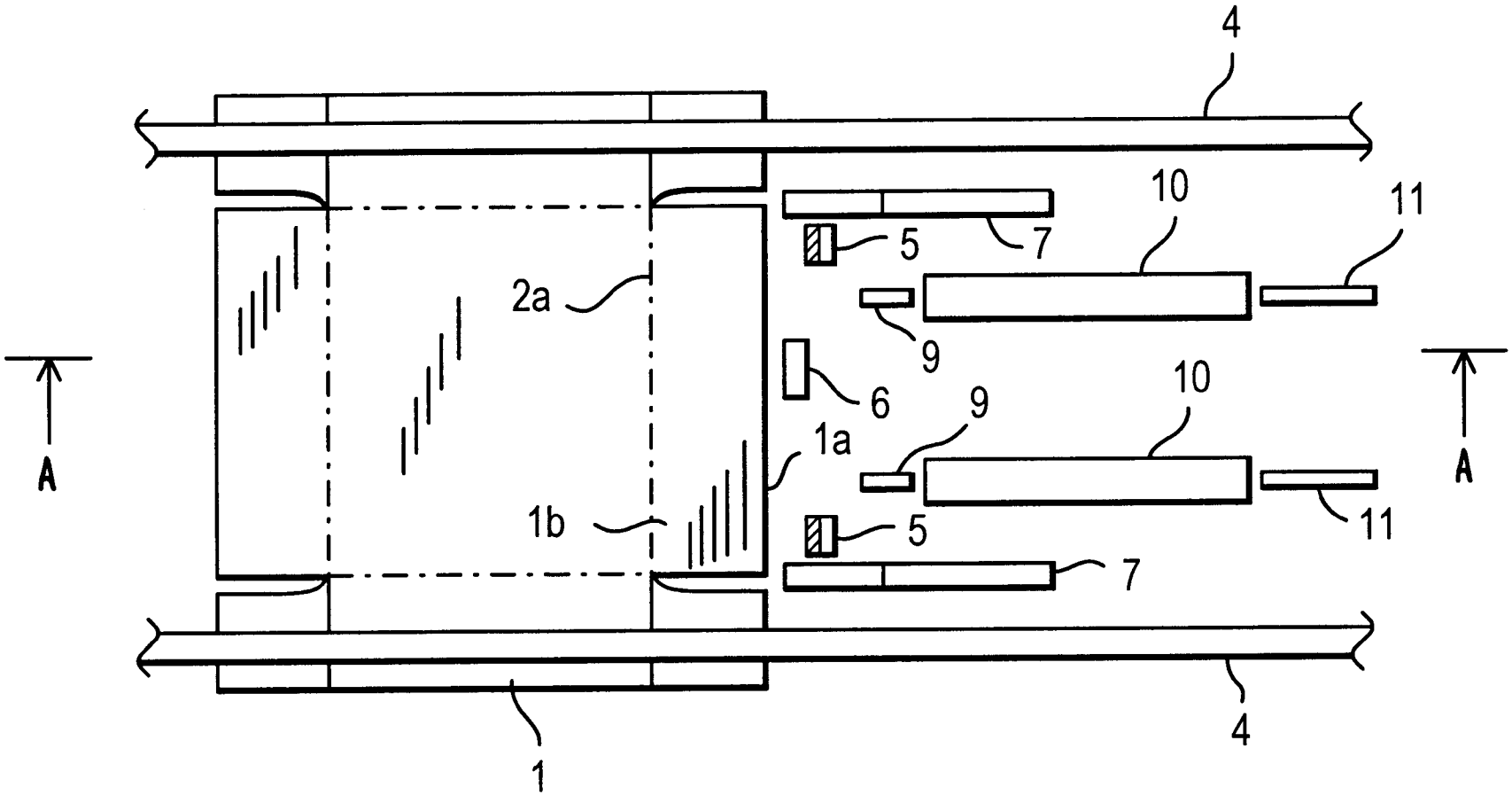
FIG. 1 is a schematic plan view of an apparatus for bending a box sheet according to the present invention.
Figure 2:
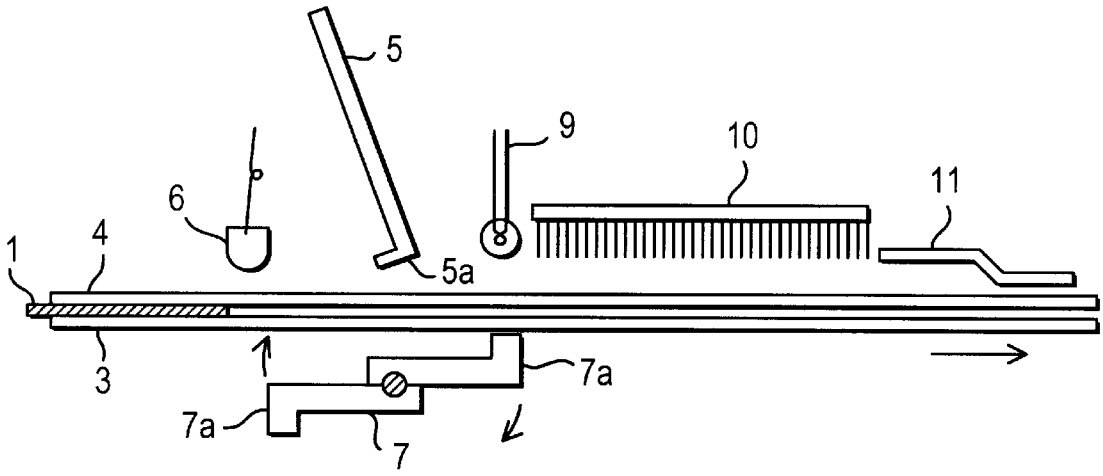
FIG. 2 is a cross-sectional view taken from line A—A of FIG. 1.

FIGS. 1 and 2 show an apparatus for bending a box sheet according to the present invention.

It is the apparatus for automatically bending a box sheet 1 along a fold 2 formed at a predetermined position in the box sheet 1. The apparatus for bending a box sheet comprises two pairs of belts 3, 4 which can send the box sheet 1, a pair of hooks 5, a sensor 6 which can detect a tip 1*a* of the sending box sheet 1, and a lifting arm 7 which can lift a part 1*b* between the tip 1*a* and a first fold 2 of the sending box sheet up.

Hook 5 is provided and is pressed by a spring (not pictured) from an opposite direction (left direction of FIGS. 1 and 2) of the sending direction of the box sheet 1 and for moving the sending direction (right direction of FIGS. 1 and 2) of the box sheet 1. A tip 5*a* of the hook 5 is bent for the opposite direction of the sending direction of the box sheet 1 and therefore can hold the tip 1*a* of the sending box sheet 1. As shown in FIG. 1, the tip 5*a* of the hook 5 is positioned above a sending route of the box sheet 1, which is sending between belts 3 and 4.

Figure 3:
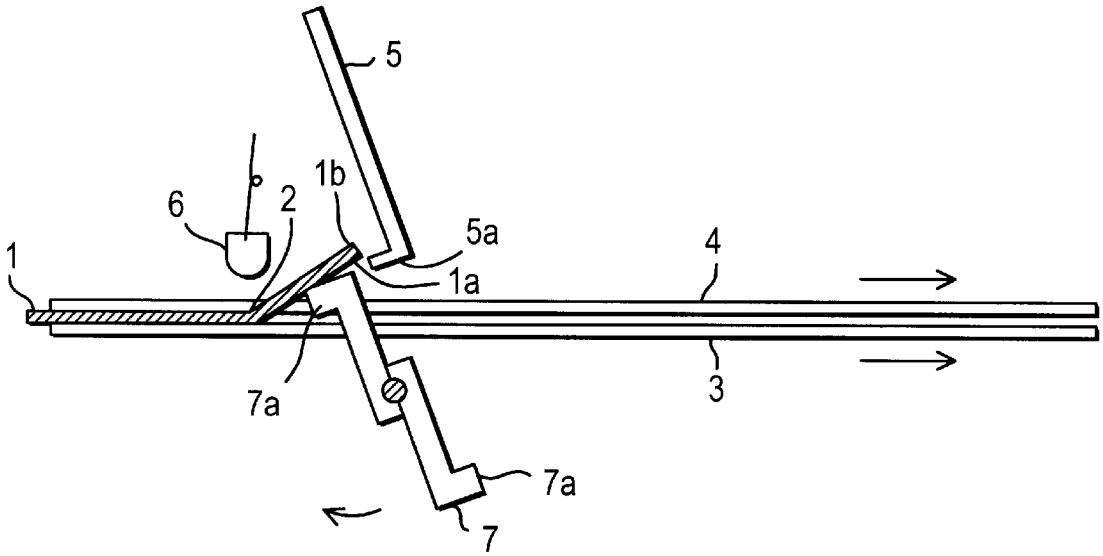
FIG. 3, FIG. 4, FIG. 5 and FIG. 6 are schematic plan views of an apparatus for bending a box sheet according to the present invention, which indicate a movement of the apparatus.
Figure 7:
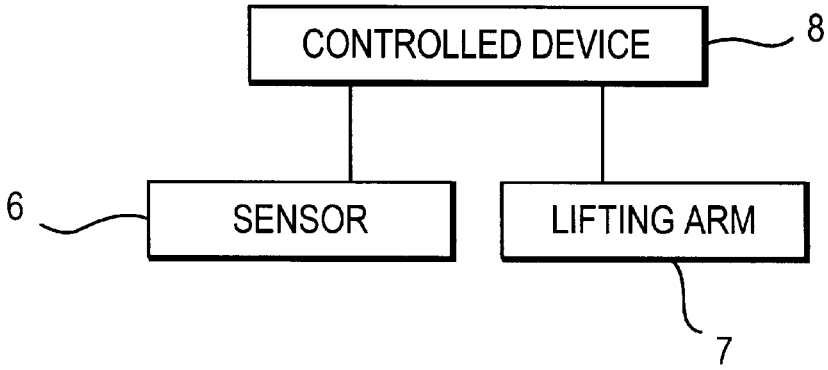
FIG. 7 is a schematic block diagram of control system according to the present invention.
Figure 8A:
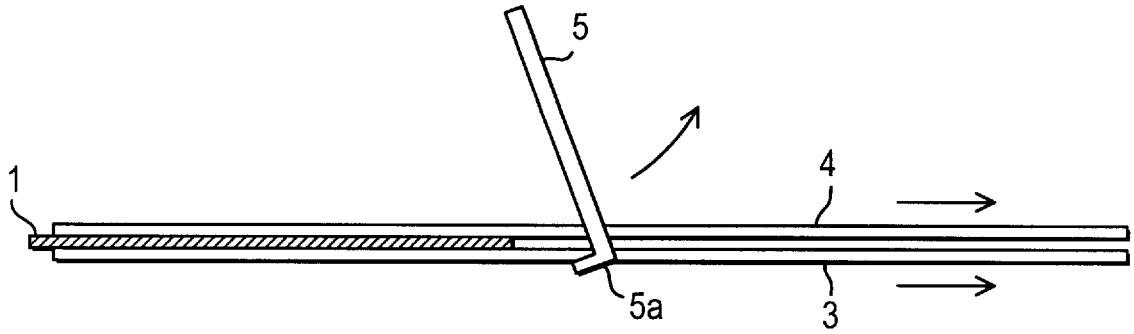
FIG. 8a PRIOR ART
FIGS. 8A–8C are schematic plan views of an apparatus for bending a box sheet according to a typical invention, which indicate a movement of the apparatus.
Figure 8B:
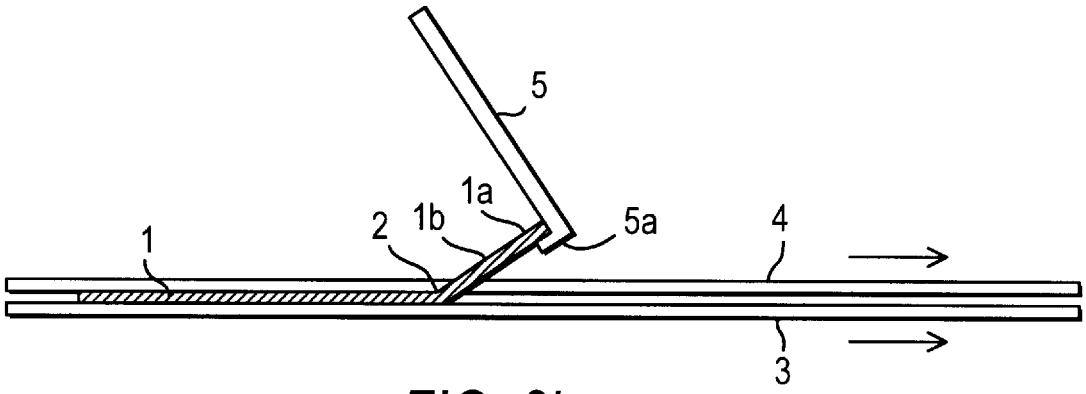
FIG. 8b PRIOR ART
Figure 8C:
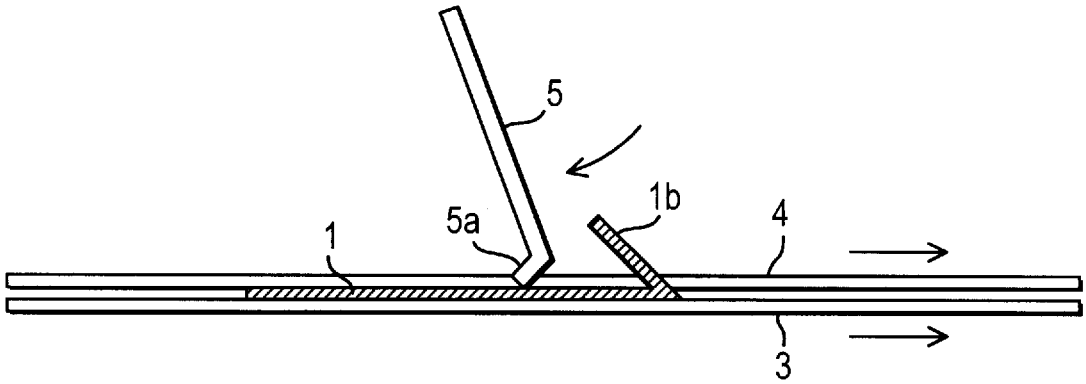
FIG. 8c PRIOR ART

The lifting arm 7 comprises a pair of arms shaped in a letter of "L". Each of the arms is combined back to back. The lifting arm 7 can rotate so as to move the tip 7*a* of the lifting arm 7 at same speed and direction as the sending box sheet 1, when the tip 7*a* of the lifting arm 7 is positioned at the most upper part. As shown in FIG. 3, the lifting arm 7 is set up below the belts 3, 4 so as to lift the part 1*b* between the tip 1*a* and a first fold 2 of the sending box sheet at the time when each tip 7*a* is nearly positioned at the most upper part. As shown in FIG. 7, the lifting arm 7 is connected to a controlled device, 8, which can control the lifting arm 7.

Figure 6:
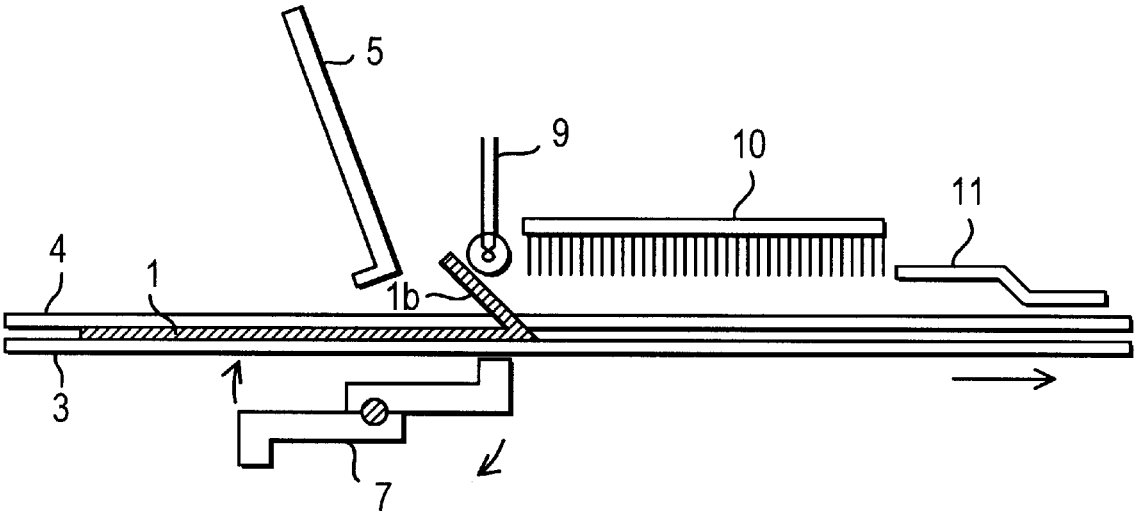

The sensor 6 is provided so as to be above the belts 3, 4 and to be in the same position as the lowest reaches of the tip 7*a* of the lifting arm 7. As shown in FIG. 6, the sensor 6 is connected to the controlled device 8. When the sensor 6 detects the tip 1*a* of the sending box sheet 1, the sensor 6 sends an information concerning the detection of the tip 1*a* of the sending sheet 1 to the controlled device 8. When the controlled device 8 receives the information, the controlled device 8 makes the lifting arm 7 rotate from a horizontal position of the lifting arm 7.

A roller 9, a brush 10 and a guided rail 11 are provided above the belts 3, 4 and at the upper reaches of the hook 5. A space between the belt 3 and roller 9, brush 10 and a guided rail 11, is shorter than the part 1*b* between the tip 1*a* and a first fold 2 of the sending box sheet. Therefore, the box sheet 1 is sent with bending by passing through this roller 9, brush 10 and guided rail 11.

Next. an operation of the apparatus for bending the sending box sheet according to the present embodiment is described. First, the box sheet 1 is sent one after another by operating the belts 3, 4. When the tip 1*a* of the box sheet 1 is passed through the sensor 6, the sensor 6 detects the tip 1*a* of the box sheet 1, and then sends the information concerning the detection of the tip 1*a* of the sending sheet 1 to the controlled device 8. When the controlled device 8 accepts the information, the lifting arm 7 begins to rotate. When the lifting arm 7 begins to rotate, as shown in FIG. 3, a back face of the part 1*b* between the tip 1*a* and a first fold 2 of the sending box sheet is pressed by the tip 7*a* of the lifting arm 7, and then, the box sheet 1 is bent along the fold 2 until the tip 1*a* of the box sheet 1 reaches the height of the tip 5*a* of the hook 5. In this time, because the tip 7*a* of the lifting arm 7 is rotating at the same direction and speed as the sending box sheet 1, when the lifting arm 7 presses the back face of the box sheet 1, almost no noise is made.

Figure 4:
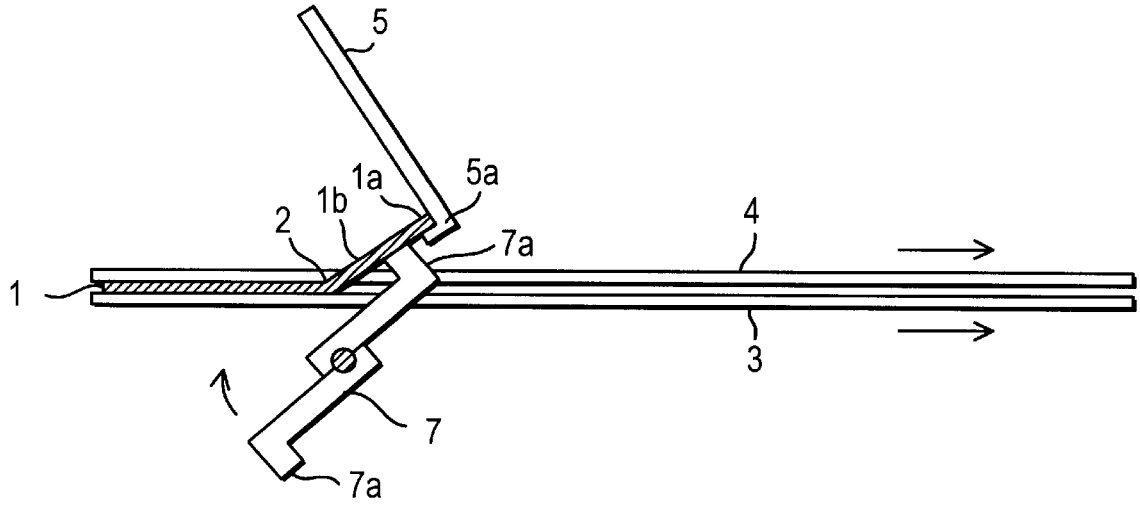
Figure 5:
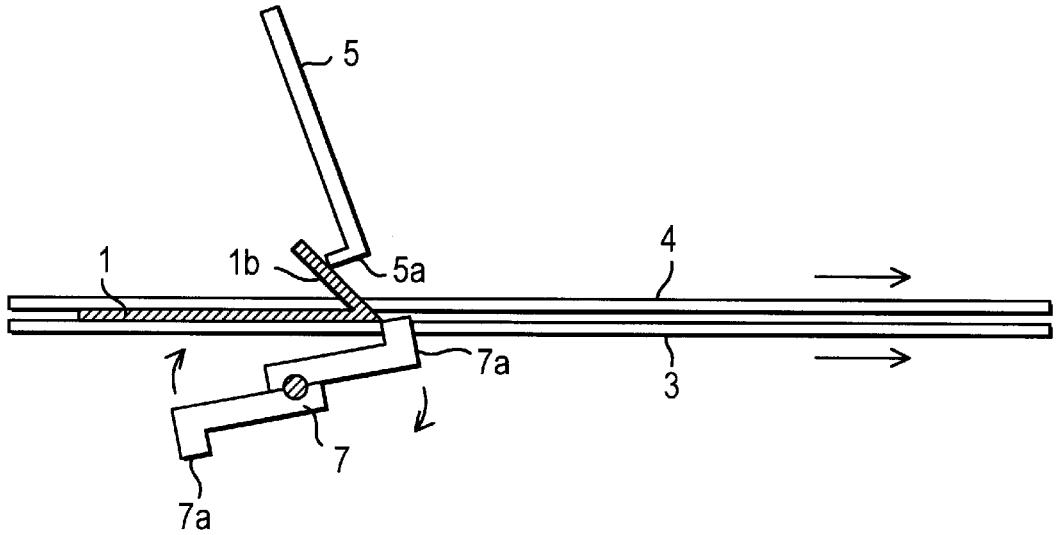

When the box sheet 1 is further sent, as shown in FIG. 4, the tip 1*a* of the box sheet 1 is held by the tip 5*a* of the hook 5. When the box sheet 1 is further sent, the hook 5 moves at the sending direction of the box sheet 1. And, when the box sheet 1 is further sent, as shown in FIG. 5, the box sheet 1 is bent along the fold 2. When the box sheet 1 is further sent as shown in FIG. 6, the tip 5*a* of the hook 5 is left of the tip 1*a* of the box sheet 1, and the hook 5 is restored by a restitution force of the spring. Then, the bending box sheet 1 is sent to the roller 9, brush 10 and guided rail 11.

In this time, as shown in FIG. 6, the hook 5 left from the tip 1*a* of the box sheet 1 is restored, but because the tip 5*a* is positioned above the sending route of the box sheet 1, the tip 5*a* does not hit a face of the sending box sheet 1. Therefore a noise is not made and the face of the box sheet 1 is not damaged.

A result of a test for measuring a noise of the apparatus for bending the box sheet which does not send the box sheet, and the apparatus for bending the box sheet according to the present embodiment, as well as a typical apparatus for bending the box sheet are all indicated in Chart 1.

CHART 1

| Sending Speed | 50 m/m | 100 m/m | 150 m/m |
|---|---|---|---|
| The Apparatus for Bending the Box Sheet which is sending the box sheet | 62 db | 65 db | 70 db |
| The Apparatus for Bending the Box Sheet according to the present invention | 68 db | 74 db | 79 db |
| The Typical Apparatus for Bending the Box Sheet | 76 db | 80 db | 83 db |

In the present embodiment, although the part 1*b* between the tip 1*a* and a first fold 2 of the sending box sheet is lifted up by rotating of the lifting arm 7, the part 1*b* may be lifted up by a cylinder. And although the lifting arm 7 is electrically controlled, it may be mechanically controlled.

The present inventionbeing thus described, itwillbe obvious that the same maybe varied in many ways. Such variations are not to be regarded as being a departure from the spirit and scope of the present invention, and all such modification as would be obvious to one skilled in the art are intended to be included within the scope of the present invention as defined by the following claims.

What is claimed is:

1. An apparatus for bending a box sheet along a fold formed at a predetermined position in the box sheet, comprising:

a sensor for detecting a tip of the box sheet moving along a sending route;

a hook comprising a tip positioned above the sending route of the box sheet for holding said tip of the box sheet; and a lifting device for lifting a part of the box sheet between said tip of the box sheet and said fold until said tip of the box sheet comes in contact with said tip of the hook positioned above the sending route of the box sheet when said sensor detects said tip of the box sheet;

wherein said tip of the hook operates above the sending route of the box sheet to hold said tip of the box sheet when the box sheet is lifted by said lifting device, thereby bending the box sheet along said fold and releasing said tip of the box sheet as the box sheet moves along the sending route.

2. The apparatus of claim 1, wherein said lifting device rotates in the same direction and substantially at the same speed as the box sheet to thereby minimize noise when said lifting device comes in contact with said box sheet.

3. A method of bending a box sheet along a fold at a predetermined position in the box sheet, comprising the step of:

moving the box sheet along a sending route;

detecting a tip of the box sheet moving along the sending route of the box sheet; and lifting a part of the box sheet between said tip of the box sheet and said fold until said tip of the box sheet comes in contact with a hook comprising a tip positioned above the sending route of the box sheet when said tip of the box sheet is detected;

wherein said tip of the hook operates above the sending route of the box sheet to hold said tip of the box sheet when the box sheet is lifted by said lifting device, thereby bending the box sheet along said fold and releasing said tip of the box sheet as the box sheet moves along the sending route.

4. The method of claim 3, wherein said lifting device rotates in the same direction and substantially at the same speed as the box sheet to thereby minimize noise when said lifting device comes in contact with said box sheet.

* * * * *